US011636718B2

(12) United States Patent
Staehlin

(10) Patent No.: US 11,636,718 B2
(45) Date of Patent: Apr. 25, 2023

(54) METHOD FOR OPERATING A MOTOR VEHICLE ACCIDENT DATA MEMORY AND ACCIDENT DATA MEMORY SYSTEM

(71) Applicant: Continental Teves AG & Co. OHG, Frankfurt am Main (DE)

(72) Inventor: Ulrich Staehlin, Oakland Township, MI (US)

(73) Assignee: Continental Teves AG & Co. oHG

( * ) Notice: Subject to any disclaimer, the term of this patent is extended or adjusted under 35 U.S.C. 154(b) by 431 days.

(21) Appl. No.: 16/500,222

(22) PCT Filed: Mar. 27, 2018

(86) PCT No.: PCT/DE2018/200030

§ 371 (c)(1),
(2) Date: Oct. 2, 2019

(87) PCT Pub. No.: WO2018/184640

PCT Pub. Date: Oct. 11, 2018

(65) Prior Publication Data

US 2021/0056785 A1 Feb. 25, 2021

(30) Foreign Application Priority Data

Apr. 5, 2017 (DE) ..... 10 2017 205 793.9

(51) Int. Cl.
*G07C 5/10* (2006.01)
*G07C 5/08* (2006.01)

(52) U.S. Cl.
CPC ..... *G07C 5/0841* (2013.01); *G07C 5/10* (2013.01)

(58) Field of Classification Search
CPC ..... G07C 5/0841; G07C 5/10; G07C 5/085
See application file for complete search history.

(56) References Cited

U.S. PATENT DOCUMENTS 5,757,916 A * 5/1998 MacDoran ..... G01S 19/215 380/258
5,916,300 A * 6/1999 Kirk ..... G01S 19/44 73/178 R
5,923,286 A * 7/1999 Divakaruni ..... G01C 21/165 342/357.44

(Continued)

FOREIGN PATENT DOCUMENTS

CA 2947936 A1 * 11/2014 ..... G06Q 50/265
CA 3008512 A1 * 12/2018 ..... G06Q 10/0833

(Continued)

OTHER PUBLICATIONS

Chinese Office Action and Search Report dated Apr. 6, 2021 in Chinese Patent Application No. 201880023787.X, 10 pages, with English partial Summary of the Chinese Examiner's Comments, 2 pages.

(Continued)

*Primary Examiner* — Shelley Chen
(74) *Attorney, Agent, or Firm* — RatnerPrestia

(57) ABSTRACT

In a motor vehicle accident data memory and method of operating it, a reference time is determined by a satellite navigation system, and a system time is synchronized with the reference time. When an accident is detected, accident data and the system time are recorded in a non-volatile memory.

11 Claims, 1 Drawing Sheet

(56) References Cited

U.S. PATENT DOCUMENTS

| | | | | |
|---|---|---|---|---|
| 6,081,163 | A * | 6/2000 | Ujiie | H03L 7/18 331/25 |
| 6,493,650 | B1 * | 12/2002 | Rodgers | G08G 3/00 340/815.69 |
| 8,219,280 | B2 | 7/2012 | Ishikawa | |
| 8,240,287 | B2 | 8/2012 | Hashimoto et al. | |
| 8,291,149 | B2 | 10/2012 | Azuma et al. | |
| 9,821,999 | B2 * | 11/2017 | Rudow | G01S 19/41 |
| 2003/0046003 | A1 * | 3/2003 | Smith | G01C 15/00 342/357.31 |
| 2005/0216147 | A1 * | 9/2005 | Ferman | G08G 1/0104 701/409 |
| 2007/0058812 | A1 | 3/2007 | Ali et al. | |
| 2010/0129064 | A1 | 5/2010 | Maeda et al. | |
| 2010/0204918 | A1 * | 8/2010 | Joo | G04R 20/02 701/469 |
| 2012/0105278 | A1 * | 5/2012 | Riedinger | G01C 21/165 342/357.3 |
| 2012/0208557 | A1 * | 8/2012 | Carter | G01S 19/23 455/456.1 |
| 2012/0249343 | A1 * | 10/2012 | Thomas | G08G 1/096783 340/905 |
| 2013/0030642 | A1 * | 1/2013 | Bradley | G07C 5/008 701/32.2 |
| 2013/0253760 | A1 * | 9/2013 | Berman | G07C 5/0841 701/32.2 |
| 2013/0300552 | A1 * | 11/2013 | Chang | B60Q 9/00 340/436 |
| 2014/0368601 | A1 * | 12/2014 | deCharms | H04N 7/147 348/14.02 |
| 2015/0009067 | A1 * | 1/2015 | Rudow | G01P 13/00 342/357.51 |
| 2015/0309181 | A1 * | 10/2015 | Stahlin | G01S 19/42 342/357.51 |
| 2016/0192166 | A1 * | 6/2016 | deCharms | H04W 4/029 348/14.02 |
| 2016/0314628 | A1 | 10/2016 | Chapman et al. | |
| 2017/0337753 | A1 * | 11/2017 | Joodaki | G06K 9/22 |
| 2018/0080795 | A1 * | 3/2018 | Roy | G01S 19/47 |

FOREIGN PATENT DOCUMENTS

| | | | | |
|---|---|---|---|---|
| CA | 3010133 | A1 * | 12/2018 | G06Q 10/0833 |
| CN | 101739739 | A | 6/2010 | |
| CN | 101806257 | A | 8/2010 | |
| CN | 101896943 | A | 11/2010 | |
| CN | 203352548 | U * | 12/2013 | |
| CN | 205334566 | U | 6/2016 | |
| DE | 102004012228 | | 9/2005 | |
| DE | 102014211168 | A1 * | 12/2015 | G01C 21/165 |
| EP | 1 462 885 | | 9/2004 | |
| JP | H08275081 | A * | 3/1995 | |
| JP | 3569190 | B2 * | 9/2004 | |
| JP | 2005037491 | A * | 2/2005 | |
| JP | 2005257484 | A | 9/2005 | |
| JP | 2014035336 | A | 2/2014 | |
| JP | 5585194 | B2 * | 9/2014 | |
| WO | WO-2012038250 | A1 * | 3/2012 | G01C 21/00 |
| WO | WO-2014095376 | A1 * | 6/2014 | G01P 3/487 |

OTHER PUBLICATIONS

Chinese Office Action dated Sep. 17, 2021 in Chinese Patent Application No. 201880023787.X, 8 pages, with Brief Summary of the Chinese Examiner's Comments, 1 page.

PCT Examiner Wolf Holzmann, English translation of the International Search Report of the International Searching Authority for International Application PCT/DE2018/200030, dated Jun. 21, 2018, 3 pages, European Patent Office, HV Rijswijk, Netherlands.

PCT Examiner Nora Lindner, PCT International Preliminary Report on Patentability including English Translation of PCT Written Opinion of the International Searching Authority for International Application PCT/DE2018/200030, dated Oct. 8, 2019, 8 pages, International Bureau of WIPO, Geneva, Switzerland.

German Examiner Kathrin Arnold, German Search Report for German Patent Application No. 10 2017 205 793.9, dated Mar. 26, 2018, 10 pages, German Patent and Trademark Office, Muenchen, Germany, with partial English translation, 8 pages.

Isaac Skog et al., "In-Car Positioning and Navigation Technologies—A Survey", IEEE Transactions on Intelligent Transportation Systems, vol. 10, No. 1, Mar. 1, 2009, XP011347156, ISSN: 1524-9050, pp. 4 to 21.

"Crystal Oscillator", Wikipedia, Feb. 25, 2017, XP055483914, retrieved from the Internet: https://en.wikipedia.org/wiki/Crystal_oscillator, retrieved on Jun. 22, 2018, pp. 1 to 15.

"What is SBAS?", European Global Navigation Satellite Systems Agency, Mar. 20, 2017, XP055483948, retrieved from the Internet: https://web.archive.org/web/20170320212643/https://www.gsa.europa.eu/european-gnss/what-gnss/what-sbas, retrieved on Jun. 22, 2018, pp. 1 to 4.

"SBAS Fundamentals", Navipedia, Dec. 10, 2016, XP055484330, retrieved from the Internet: https://web.archive.org/web/20161210192610/http://www.navipedia.net/index.php/SBAS_Fundamentals, retrieved on Mar. 29, 2018, pp. 1 to 9.

"Oszillatorschaltung", Wikipedia, May 20, 2018, https://de.wikipedia.org/wiki/Oszillatorschaltung, retrieved on Mar. 29, 2018, pp. 1 to 7 (in German), see Reference AI for corresponding English entry for "Oscillator Circuit" in Wikipedia.

Chinese Office Action for Chinese Application No. 201880023787.X, dated Apr. 1, 2022 with translation, 11 pages.

European Examination Report for European Application No. 18 720 094.4, dated Apr. 25, 2022 with translation, 14 pages.

* cited by examiner

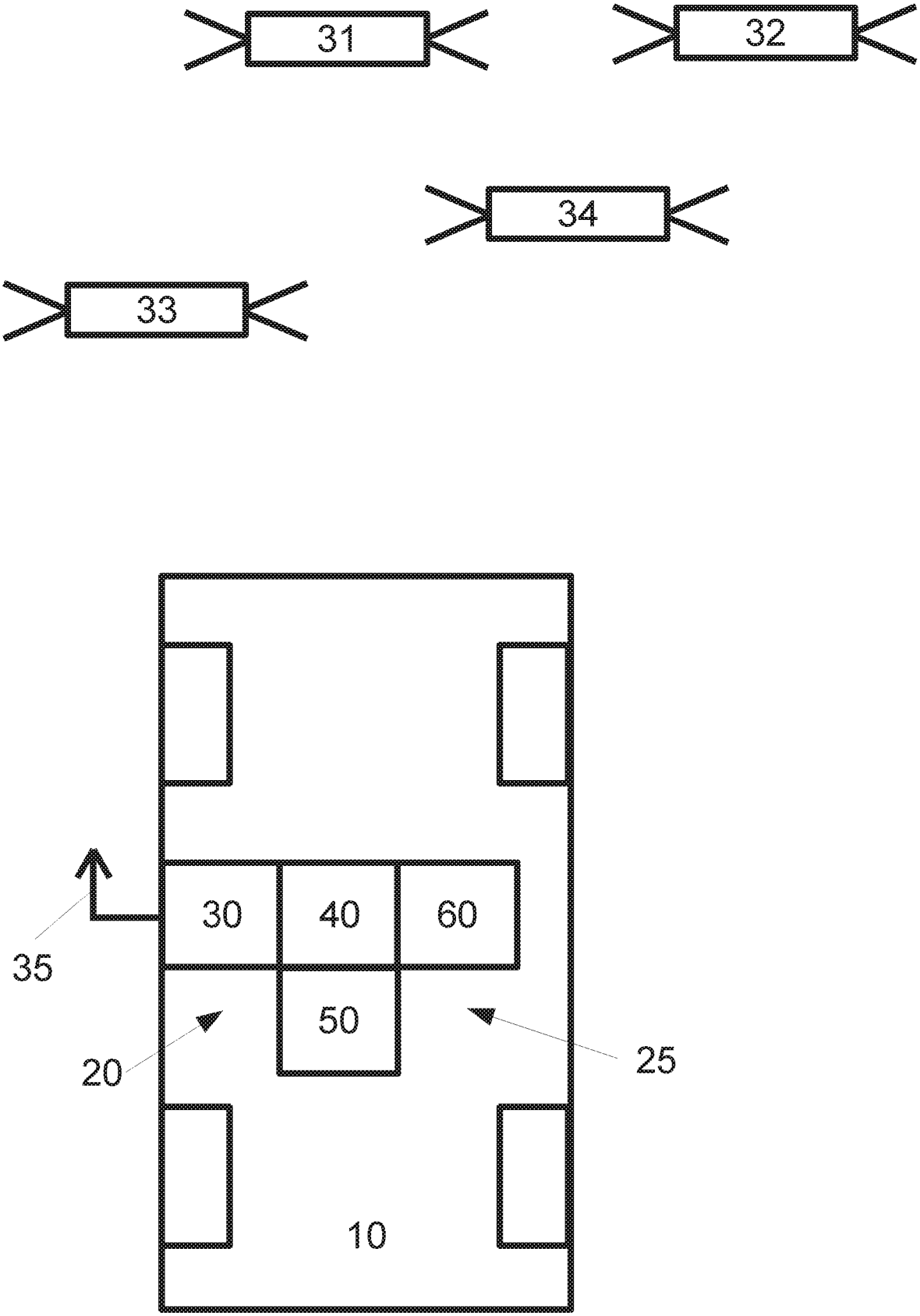
31
32
34
33
30
40
60
50
35
20
25
10

METHOD FOR OPERATING A MOTOR VEHICLE ACCIDENT DATA MEMORY AND ACCIDENT DATA MEMORY SYSTEM

FIELD OF THE INVENTION

The invention relates to a method for operating a motor vehicle accident data memory and an accident data memory system for executing such a method.

BACKGROUND INFORMATION

Motor vehicle accident data memories are in principle known, wherein they typically record data such as, for example, speed, steering angle and acceleration in a reliable manner immediately prior to and following a known accident. As a result, the sequence of events leading to an accident can be reconstructed and, for example, the guilt or innocence of a respective driver can be ascertained. In the course of introducing autonomous vehicles, in which the identification of any technical problems assumes a central role in the event of an accident, accident data memories will in future be deployed far more frequently than they have been to date.

One important piece of information for reconstructing an accident is the time at which an accident occurred and at which specific recorded values apply. Consequently, it is important to provide a precise time reference for an accident data memory.

Ideally, it is possible to, for example, synchronize on a global basis, which can in particular be provided by a satellite navigation system (GNSS=Global Navigation Satellite System). However, a time from a satellite navigation system is not always available, nor is it always reliable.

SUMMARY OF THE INVENTION

It is therefore an object of the invention to provide a method for operating an accident data memory which is improved in terms of the provision of a time for the accident data memory. It is also an object of the invention to provide an associated accident data memory system.

The above objects can be achieved according to the invention by a method and an accident data memory system respectively having features as set forth herein.

The invention relates to a method for operating a motor vehicle accident data memory. The method has the following steps:

- determining a reference time by means of a satellite navigation system,
- synchronizing a system time of the accident data memory with the reference time,
- in the event that an accident is detected, recording accident data and the system time in a non-volatile memory of the accident data memory.

Due to the use of the system time, a separate time basis for the accident data memory can be provided. This can in particular be operated and pursued independently of the reference time, i.e. it can also be continued if a reception of satellite navigation signals is not currently available. This can be the case, for example, if the vehicle is located in a tunnel, in a garage or between high buildings.

The non-volatile memory is in particular a memory which stores the data stored thereon over a longer period of time and in particular also independently of a power supply, in particular of an external power supply.

The synchronizing can be carried out, for example, by means of Network Time Protocol, NTP, Precision Time Protocol, PTP, or AUTOSAR time synchronization. Such protocols or techniques have proven successful in practice.

The accident data can relate, for example, to a period of time of a maximum of 10 s prior to the detection of the accident up to a maximum of 10 s following the detection of the accident. These are typical data which are to be usefully enlisted in order to evaluate an accident.

Integrity data regarding the reference time can preferably also be generated by means of the satellite navigation system. Such integrity data are data which display the reliability of the reference time generated from satellite navigation.

When an accident is detected, integrity data are preferably recorded in the non-volatile memory. Consequently, in addition to the actual time, a piece of information regarding the reliability of this time can also be recorded in the non-volatile memory and, consequently, can be considered during the evaluation of the accident. If, for example, at the time of the accident, only a poor integrity exists, this can also be considered during the evaluation of the accident.

The integrity data can in particular be wholly or partially based on a satellite-based augmentation system, also referred to as SBAS. Such satellite-based augmentation systems have proven to be advantageous for increasing the precision and reliability of satellite navigation systems.

According to a preferred embodiment, in the event of a failure of the reference time, an integrity level based on integrity data existing prior to the failure of the reference time continues to be calculated and is also recorded when an accident is detected. Consequently, the reliability can also be assessed in the event of a failure of the reference time and can be considered during the reconstruction of an accident. Typically, during a time in which a satellite signal is not available or the establishment of the time based on satellite navigation is otherwise disturbed, the integrity level will continually decrease.

The system time can be advantageously managed in a clock of a unit containing the accident data memory, for example an accident data memory system. The system time can also be managed in a clock of the accident data memory.

In the event of a failure of the reference time, the system time can in particular be updated by means of a number of decaying storage elements. Such storage elements can be, for example, capacitors, coils or other elements which modify a measurable variable in a defined way. This means that, in the event of a failure of the reference time, the system time can also be updated with a defined accuracy.

The storage elements can in particular be calibrated when the reference time is present. In particular, this can be carried out continually such that the last calibration does not lag far behind in the event of a failure of the reference time.

The calibration can in particular be carried out, taking account of one or more of the following influence variables:

- temperature,
- air humidity,
- radiation,
- air pressure,
- voltage level of a voltage supply,
- age.

These are influence variables which have a relevant influence on the decay behavior of typical decay elements or typical decaying storage elements. The age can in particular be an age of the decaying storage element or of a corresponding unit.

Data relating to the calibration are preferably recorded in the non-volatile memory. This can in particular also be carried out independently of the accident. For example, such data can thus also be recorded continually. This means that the calibration can be tracked at any time. The data relating to the calibration can, however, also be recorded in response to an accident.

A plurality of storage elements having different time constants and/or different types can advantageously be used. As a result, an updating of a time to different time scales, i.e. in the event of different outage times, can be reliably achieved. For example, storage elements having a short time constant can be used for short interruption times, while storage elements having long time constants can be used for long outage times.

Typical examples of storage elements are capacitors or coils such that, for example, different types can be used accordingly. This means that a comparison between the storage elements of different types can also be carried out. In order to provide, for example, different time constants with capacitors, capacitors having different dielectrics or different electrode surfaces, for example, can be used.

When an accident is detected, raw data of the satellite navigation system are additionally preferably recorded in the non-volatile memory. This makes possible an even more accurate reconstruction of the time at the time of the accident than by updating a time in the vehicle.

Furthermore, the invention relates to an accident data memory system. The accident data memory system has a non-volatile memory. The accident data memory system has a clock for managing a system time. In addition, the accident data memory system has an electronic control apparatus which is configured to execute a method according to the invention.

The advantages already described above can be achieved for an accident data memory system by means of the accident data memory system according to the invention. In particular, a reliable time can be provided. With respect to the method according to the invention, recourse can be had to all of the embodiments and variants described herein.

The accident data memory system can additionally have a satellite navigation module for generating the reference time. This makes possible a particularly high integration and a joint power supply. However, it is also indicated that an external satellite navigation module can alternatively also be used to generate the reference time.

The invention also relates to a non-volatile, computer-readable storage means which contains programming code. When said programming code is run, a method according to the invention is carried out. With respect to the method according to the invention, recourse can be had to all of the embodiments and variants described herein.

The aforementioned information of a satellite-based augmentation system can in particular contain integrity information regarding the atmosphere and regarding the satellite system or satellite navigation system.

A time of a unit, in which the accident data memory is contained, can in particular be synchronized with an integer time. To this end, the protocols indicated above can be used for example. In addition, an integrity of the synchronization can still be determined in order, in the event of a missing satellite navigation signal, to be able to update the integer time and the integrity level thereof.

The aforementioned storage elements can in particular also ensure that a time is provided, which is immediately available when the system is started and is not dependent on satellite reception. This means that a time can be used immediately, for example following a period of standing in garages, which is advantageous, as an accident can already occur before the satellite navigation data are received.

Due to the aforementioned recording of calibration data, including independently of an accident, changes in the calibration data can be detected and can be taken into account in an evaluation.

The aforementioned influence variables on the calibration can likewise be stored in the non-volatile memory in order, in the event of an accident, to be able to make any necessary corrections during the evaluation of the data. For example, this can be required if the calibration has not been completed.

A system for determining the time including a satellite navigation receiver is preferably integrated into a unit which also contains the accident data memory. It can thus be ensured that, in the event of an accident, the important time information can still be provided and are also supplied with emergency operation current. Furthermore, it is possible to certify the unit as such without having to certify a vehicle completely.

External correcting information can also be used as an aid regarding the raw data, which have already been indicated and which can also be recorded, in order to subsequently obtain further information from these data offline. This is in particular a good idea if no reception of a satellite-based augmentation system exists.

BRIEF DESCRIPTION OF THE DRAWINGS

The person skilled in the art will infer further features and advantages from the embodiment example described below with reference to the appended FIGURE, wherein:

FIG. 1: shows a vehicle having an accident data memory system.

FIG. 1 shows a vehicle 10 in a purely schematic form.

DETAILED DESCRIPTION OF EXAMPLE EMBODIMENTS OF THE INVENTION

The vehicle 10 has an accident data memory system 20 which is likewise represented purely schematically.

The accident data memory system 20 has a satellite navigation module 30. An outside antenna 35 is mounted thereon. The outside antenna 35 is designed to receive signals from satellites 31, 32, 33, 34 which are merely represented schematically. A location of the vehicle 10 can in particular be established therewith. Furthermore, a time of day can be determined as the reference time by the satellite navigation module 30 based on the satellite signals.

The accident data memory system 20 further has a clock 40. This is used for managing a system time. The system time is continually synchronized with the reference time determined by the satellite navigation module 30 for as long as the reference time is available.

Furthermore, the clock 40 has a number of decaying storage elements (not represented) in the form of multiple different capacitors. These are continually calibrated for as long as the reference time 30 is available. Should the reference time 30 not be available, for example because the vehicle 10 is located in a tunnel or in a garage and, correspondingly, no signals can be received from the satellites 31, 32, 33, 34, the system time is updated in the clock 40 with the aid of the storage elements. To this end, recourse can be had to the known decay behavior, in each case, and in particular the respective time constant of the respective storage element.

Furthermore, the accident data memory system 20 has a non-volatile memory 50. Data can thus be recorded in this non-volatile memory 50 such that they are read out again independently of a power supply.

Furthermore, the accident data memory system 20 has an electronic control apparatus 60. This is configured to execute a method according to an embodiment example of the invention.

The non-volatile memory 50 and the control device 60 can be considered jointly as an accident data memory 25.

If an accident is detected, which will not be dealt with in greater detail here, accident data are recorded in the non-volatile memory 50. These data are, for example, data from acceleration sensors, steering wheel angle sensors or other data which can be helpful for reconstructing the sequence of events leading to an accident. Such data relate to a period of time of 10 s prior to the accident up to 10 s following the accident. For example, an accident can be detected as a result of a control device triggering an airbag.

In the event of a detected accident, the system time from the clock 40 is stored in the non-volatile memory 50. Consequently, an accurate value for the time at which the accident happened can be recorded in the non-volatile memory 50.

Integrity data, which relate to the integrity of the respective reference time, are additionally constantly generated by the satellite navigation module 30. These data are also recorded in the non-volatile memory 50 such that the integrity of the respective time can be reconstructed. The integrity data are in particular based on a satellite-based augmentation system.

The sequence of events leading to the accident can be reconstructed particularly well by means of the accident data memory system 20 according to the invention in the vehicle 10, in the event of the vehicle 10 having an accident, since very accurate information regarding the accident time are available and a comparison, for example, with accident data memories of other vehicles, which are likewise involved in the accident, can be carried out very accurately. As a result, malfunctions of technical systems in autonomous vehicles can, for example, also be detected.

The aforementioned steps of the method according to the invention can be executed in the indicated order. They can, however, also be executed in another order. The method according to the invention can be executed in one of its embodiments, for example with a specific combination of steps, such that no further steps are executed. However, further steps can essentially also be executed, including those which are not indicated.

The claims which form part of the application do not constitute a waiver of the attainment of more extensive protection.

If in the course of the proceedings it transpires that a feature or a group of features is not absolutely necessary, then the applicant here and now seeks a wording of at least one independent claim, no longer comprising the feature or the group of features. This may, for example, involve a sub-combination of a claim existing as at the application date or a sub-combination of a claim existing as at the application date restricted by further features. Such claims or combinations of features, which are to be newly worded, are understood to also be covered by the disclosure of this application.

It is further pointed out that configurations, features and variants of the invention, which are described in the various embodiments or embodiment examples and/or shown in the FIGURES, can be combined with one another as desired. Individual or multiple features are interchangeable as desired. Resulting combinations of features are understood to also be covered by the disclosure of this application.

Back references in dependent claims should not be construed as a waiver of the right to independent, objective protection for the features of the subclaims referred back to. These features can also be used in any combination with other features.

Features which are only disclosed in the description or features which are disclosed in the description or a claim only in conjunction with other features can, in principle, be of independent inventive relevance. They can therefore also be included separately in claims to distinguish from the prior art.

The invention claimed is:

1. A method of operating an accident data memory for a motor vehicle, comprising:

establishing a system time of the accident data memory;

obtaining raw data and a reference time from a satellite navigation system;

generating integrity data indicating reliability or integrity of the reference time from the satellite navigation system;

synchronizing the system time of the accident data memory with the reference time when the reference time is available;

receiving an accident signal indicating detection of an accident of the motor vehicle;

when the reference time becomes unavailable, calculating an integrity level of the reference time based on the integrity data existing prior to the unavailability of the reference time, and recording the integrity level of the reference time in response to the accident signal;

receiving accident data regarding the accident;

in response to the accident signal:

recording the raw data from the satellite navigation system, the accident data regarding the accident, and the system time in a non-volatile memory of the accident data memory, and recording the integrity data in the non-volatile memory; and providing the raw data, the accident data, the system time, and the integrity data from the non-volatile memory for use in an evaluation or a reconstruction of the accident.

2. The method according to claim 1, wherein the integrity data are wholly or partially based on a satellite-based augmentation system.

3. The method according to claim 1, further comprising managing the system time in a clock of a unit containing the accident data memory.

4. The method according to claim 1, further comprising managing the system time in a clock of the accident data memory.

5. The method according to claim 1, further comprising updating the system time by a number of decaying storage elements when the reference time becomes unavailable.

6. The method according to claim 5, further comprising calibrating the storage elements when the reference time is available.

7. The method according to claim 6, wherein the calibrating of the storage elements is carried out taking account of one or more of the following influence variables: temperature, air humidity, radiation, air pressure, voltage level of a voltage supply, age.

8. The method according to claim 6, further comprising recording calibration data relating to the calibrating in the non-volatile memory.

9. The method according to claim 5, wherein the storage elements include different storage elements respectively having different time constants and/or different storage element types.

10. An accident data memory system for a motor vehicle, comprising:

a non-volatile memory;

a clock for managing a system time of the accident data memory system; and an electronic control apparatus configured:

to establish the system time of the accident data memory system;

to obtain raw data and a reference time from a satellite navigation system;

to generate integrity data indicating reliability or integrity of the reference time from the satellite navigation system;

to synchronize the system time of the accident data memory system with the reference time when the reference time is available;

when the reference time becomes unavailable, to calculate an integrity level of the reference time based on the integrity data existing prior to the unavailability of the reference time, and record the integrity level of the reference time in response to the accident signal;

to receive an accident signal indicating detection of an accident of the motor vehicle;

to receive accident data regarding the accident;

in response to the accident signal, to record the raw data from the satellite navigation system, the accident data regarding the accident, the system time in the non-volatile memory of the accident data memory system, and the integrity data in the non-volatile memory; and to provide the raw data, the accident data, and the system time from the non-volatile memory for use in an evaluation or a reconstruction of the accident.

11. The accident data memory system according to claim 10, further comprising a satellite navigation module that comprises the satellite navigation system and that is configured to generate the reference time.

* * * * *